United States Patent [19]

Weber

[11] 3,980,338

[45] Sept. 14, 1976

[54] METHOD AND APPARATUS FOR CONTROLLING WATER SPRAYS OF AN UNDERGROUND EXTRACTION MACHINE

[75] Inventor: Karl-Heinz Weber, Witten-Heven, Germany

[73] Assignee: Gebr. Eickhoff, Maschinenfabrik und Eisengiesserei m.b.H., Bochum, Germany

[22] Filed: Dec. 5, 1974

[21] Appl. No.: 530,036

[30] Foreign Application Priority Data

Dec. 20, 1973 Germany ..... 2363372

[52] U.S. Cl. ..... 299/1; 299/17; 299/43

[51] Int. Cl.[2] ..... E21C 35/22

[58] Field of Search ..... 299/1, 17, 34, 43, 81

[56] References Cited

UNITED STATES PATENTS

| | | | |
|---|---|---|---|
| 3,853,354 | 12/1974 | Weirich et al. | 299/43 |

FOREIGN PATENTS OR APPLICATIONS

| | | | |
|---|---|---|---|
| 563,438 | 8/1944 | United Kingdom | 299/81 |
| 965,233 | 7/1964 | United Kingdom | 299/1 |

*Primary Examiner*—Ernest R. Purser

*Attorney, Agent, or Firm*—Brown, Murray, Flick & Peckham

[57] ABSTRACT

Water is discharged from spray nozzles toward cutting tools of a drum-cutting mining machine only during the actual time when material is released from the face of a mine. A pulse generator is driven by the traversing drive of the mining machine. The pulse output is fed to a controller which may include a computer that also receives an enabling signal produced by the secondary winding of a transformer in the power supply lines for the drive motor which is used to rotate the cutting drums of the mining machine. The enabling signal indicates an actual mining operation on the basis of the flow of current to the drive motor about a predetermined idle current load. Additional signals are fed to the controller such as a signal representing properties of the mine materials, and a signal representing characteristics of the drive system for the mining machine such as the dimensions of the capstan's chain drive wheel. The controller produces a signal which is used to operate a servo-type flow control valve in water supply lines coupled to the spray nozzles. Instead of a single flow control valve, there may be a plurality of valves arranged in parallel water lines and controlled by a stepping mechanism to open the valves in succession and increase the quantity of water discharged by the spray nozzles.

9 Claims, 3 Drawing Figures

METHOD AND APPARATUS FOR CONTROLLING WATER SPRAYS OF AN UNDERGROUND EXTRACTION MACHINE

BACKGROUND OF THE INVENTION

This invention relates to a method and apparatus for controlling the quantity of water discharged from nozzle devices toward cutting tools during the operation of a drum-cutting mining machine. More particularly, the present invention relates to a method and apparatus for detecting the speed at which a drum-cutting mining machine moves along the face of a mine during the actual mining operation and controlling the quantity of water discharged by the spray nozzles in a proportional relation depending upon the speed at which the mining machine is advanced along the face of the mine.

During the process of releasing rock, especially coal, in an underground mine, it is a common practice to spray the mined rock several times with water from high pressure pipelines in order to prevent the production of excessive quantities of dust. More specifically, in regard to drum-cutting machines, it has become common practice to incorporate such high pressure lines for water in the mining machines themselves and to direct the sprayed jets of water mainly or essentially onto the cutting chisels or bits which are carried on rotatable drums. The supply of a suitable quantity of water to the spray jets naturally depends, to a large extent, upon operating conditions. It is sufficient to spray a smaller amount of water per unit of time if the drum-cutting machine travels in a forward direction at a slow rate and if the amount of rock released per unit of time is relatively small. With faster rates of travel of the drum-cutting machine, it is necessary to spray a larger quantity of water in order to insure that only a relatively small amount of dust is produced.

A valve has heretofore been incorporated in the water supply pipeline of a drum-cutting machine to turn OFF the water supply when the machine stands idle but otherwise the valve remains fully open. As a result, the amount of sprayed water can be excessively large. There may be a critically deficient amount of sprayed water in the event that the mining machine is advanced at a relatively high rate of speed and with a correspondingly large yield of raw ore. The occurring dust will be incompletely washed down due to an insufficient amount of water; while with a lower rate of travel by the mining machine, the raw ore will be excessively wet.

SUMMARY OF THE INVENTION

It is an object of the present invention to obtain a specified and desired low water content of raw ore during the actual mining operation which is independent of travel by the mining machine along the face of the mine and designed to match the amount of sprayed water with the amount of material which is mined.

It is a further object of the present invention to control the quantity of water discharged by spray nozzles or the like toward the vicinity of the actual mining operation so that the mined ore has a desired low water content by matching the quantity of sprayed water to the amount or rate at which the ore is released in a mine.

More specifically, according to the present invention, there is provided a method of controlling the quantity of water discharged from a nozzle device toward cutting tools during operation of a drum-cutting mining machine of the type which is traversed by a drive along the footwall of the mine, the cutting tools being carried by a cutter head that is rotated by a motor on the mining machine to release material from the face of the mine, the method includes the steps of detecting the speed at which the drum-cutting machine moves along relative to the face of the mine and controlling the quantity of water discharged by a nozzle device toward the cutting tools in a proportional relation depending upon the detected speed at which the mining machine moves relative to the face of the mine.

The objects of the present invention are also obtained by providing an apparatus which includes a control device for adjusting a valve in a liquid supply line as a function of the rate at which the mining machine travels along a footwall at a mining face. Coupled to the capstan of a traversing drive for the extracting machine is a pulse transmitter which emits pulses at a rate which is proportional to the rotational speed of the capstan to thereby provide the basis for a control signal used to adjust the rate at which water is discharged from nozzles.

A computer may be utilized to provide a control signal corresponding to the desired amount of water which is to be sprayed per unit of volume of released ore. The computer receives the pulse output from a pulse transmitter associated with the capstan drive used to traverse the mining machine. The output signal from the computer provides a control signal for adjusting the quantity of water discharged by spray jets. In this way, the quantity of water which is discharged by such jets can be matched to the properties of the minerals which are being mined, the dimensions of the capstan's chain drive wheel or the rotational speed of the chain wheel itself.

Naturally, it is desired that the spray jets discharge water only during the actual time while rock is being released by the extraction machine. Thus, when the mining machine is traveling along the face of the mine in an idle mode of operation and the drum cutters are not working on the mine face, the valve in the water supply line to the spray nozzles should be closed. In view of this it is a further object of the present invention to construct the extraction machine in such a way that the passage of water in liquid supply lines to nozzles is controlled in an automatic manner without requiring control or attention by operating personnel. To realize this objective of the invention, means are provided to detect the flow of current, usually a threephase alternating current, to the drive motor for the cutting drums which provides a signal indicative of whether the drums are cutting rock or not. When these drums are cutting into the rock at the face of the mine, the current supplied to the drive motor is considerably higher than during idle rotation of the drums. In other words, the supply of pressurized water to the spray nozzles should be blocked in the absence of current or only a relatively weak current in the electric supply lines to the drive motor for the cutting drums which is used as an indication that the drums are not cutting into the rock but are, instead, running in an idle mode of operation. As used herein, the term off-load or idle current has reference to this mode of operation by the cutting drums.

In accordance with a further aspect of the present invention, a signal is generated which is proportional to the electrical current supplied to the drive motor for the cutting drums. This signal is fed to a regulator-type of control circuit and forms an enabling signal when the current to the drive motor lies above an off-load or idle-current value, whereby the control circuit is rendered operative to respond to the output from the pulse generator coupled to the capstan drive. Should the control circuit fail to receive an enabling signal which indicates that the current to the drive motor is below the off-load or idle-current value, then the valve in the liquid supply line to the spray jet is closed. In practice, therefore, the operation is such that a current transformer is connected in an electrical circuit for the drive motor of the cutting drum and that the secondary winding of the transformer forms an enabling signal that terminates the supply of water in the pipeline to spray nozzles when the current does not lie above the off-load current value indicating that the cutting drums are not in engagement with the mine face.

In a further aspect of the present invention, the water pipeline is subdivided into several parallel branch lines, each of which is provided with a check valve. These valves are controlled by a stepping mechanism whereby successively increased amounts of water are delivered to the spray nozzles. An input signal which varies with the speed at which the extraction machine is moved along the mine face, is fed to the stepping mechanism to open and close one or more of the branch lines and thus adjust in a stepwise manner the quantity of water which is supplied according to actual requirements and further to shut off the supply of water when there is an off-load current to the drive motor for the cutting drums.

These features and advantages of the present invention as well as others will be more fully understood when the following description is read in light of the accompanying drawing, in which.

Figure 1:
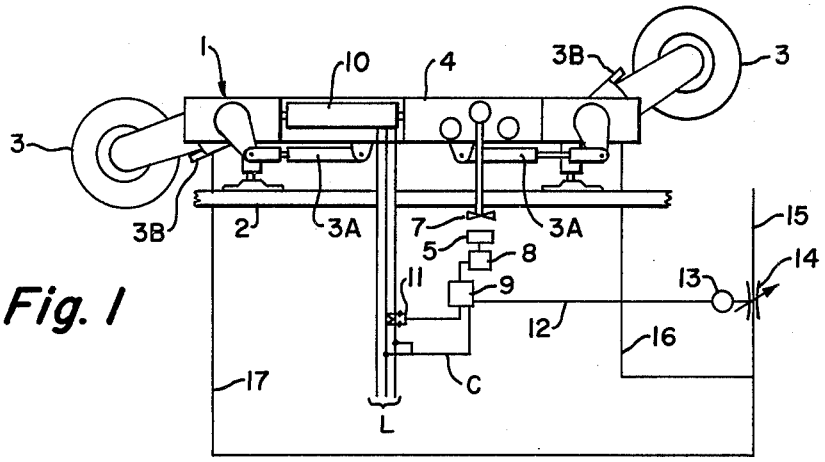
FIG. 1 illustrates a side elevational view of a drum-cutting extraction machine together with a schematic diagram of a system for controlling the quantity of water discharged from nozzles toward cutting tools.
Figure 2:
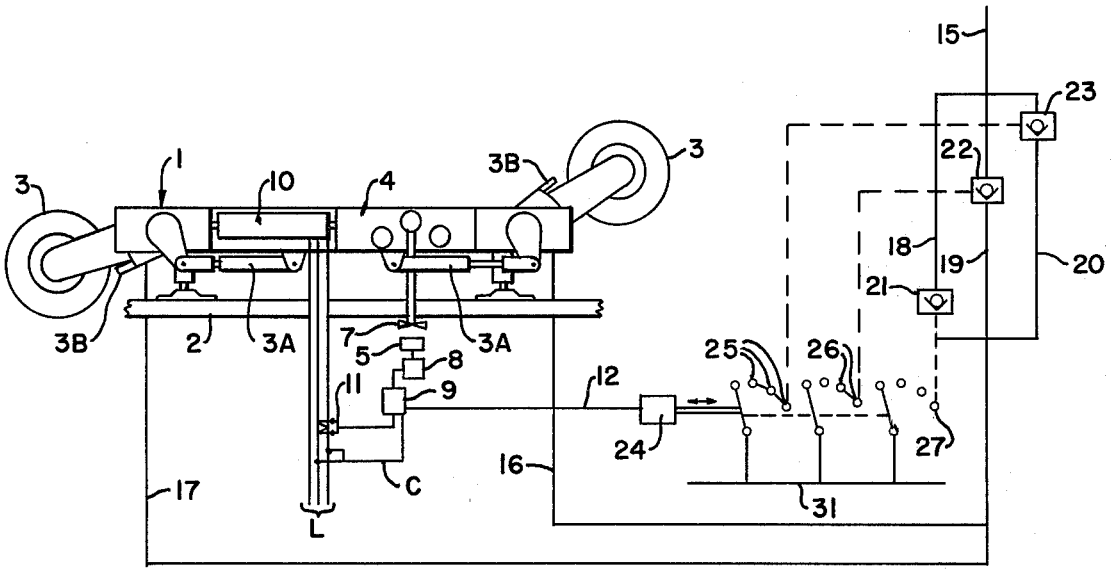
FIG. 2 is a view similar to FIG. 1 but illustrating a second embodiment of the present invention.

In FIGS. 1 and 2, there is illustrated a drum-cutting extraction machine 1 which is adapted to travel upon a longwall face conveyor 2 in a manner well known in the art. The conveyor 2 transfers the coal or ore which is released by cutting drums 3 that are raised and lowered along the mine face by piston and cylinder assemblies 3A. Spray jets or nozzles 3B are either carried by the pivotal arms that support the cutting drums 3 or they are carried by the frame of the mining machine. Such nozzles discharge water preferably toward the cutting tools mounted on the cutting drums 3 to wash down the dust produced during the cutting operation. It is a feature of the present invention to automatically match the amount of water sprayed or otherwise discharged from the nozzles 3B per unit of time according to variations in the rate at which the drum-cutting extraction machine advances along the footwall at the mine face. The automatic control of the water sprays is also intended to insure that there is a constant degree of wetness to the coal or rock which is mined or falls from the mine face.

The control system for the drum-cutting extraction machine includes a pulse transmitter 5 that is driven by a capstan drive 4 employed to traverse the drum-cutting extraction machine along the mine face. The pulse transmitter actually includes a segmented member 7 which is coupled to and driven by the chain wheel 6 of the capstan drive. As the segmented member 7 rotates, it intersects an open oscillating circuit of the pulse transmitter 5 causing changes in the field strength. In this way, within a unit of time a number of pulses per revolution of the chain wheel are produced which is proportional to the then-existing speed at which the drum-cutting extraction machine moves along the footwall of the mine. These pulses are transmitted to a computer 8 which delivers a train of pulses to a controller 9. The pulse output from the computer is proportional to the rotational speed of the chain wheel 6 and will respond to any increases or decreases of this speed. The computer may also receive additional input signals corresponding to factors such as the hardness of the minerals or coal being mined and the nature of this material in regard to the production of dust, for example.

During movement or excursions of the drum-cutting machine along the mine face, the controller 9 continually receives a signal which is proportional to the current load delivered to the drive motor 10 of the drum-cutting machine 1. This signal is produced by a current transformer 11 connected to one phase of an electric power network which includes lines L usually designed for a three-phase power supply. The signal from the current transformer 11 enables the controller 9 to transmit an output signal when there is a coincidence with the pulses from the transmitter 5. The enabling signal from the current transformer 11 exists only when the current delivered to the drive motor 10 exceeds the off-load current. Therefore, during the time while the drum-cutting machine is traveling along a mine face and extracting minerals therefrom, an output signal is delivered by line 12 from the controller which corresponds to the then-existing speed at which the drum-cutting machine is advanced but not when it is traveling without working on the mine face. In the latter case, the existence of an off-load current to the drive motor 10 blocks a signal in line 12 from the controller 9.

According to the embodiment of FIG. 1, the output signal from the controller 9 is delivered by line 12 to an operating mechanism 13 such as a servomotor coupled to a throttle valve 14. The operating mechanism 13 is responsive to the current or voltage in line 12 which is proportional to the output signal from the controller 9. An operating current is supplied by conductor C from lines L of the electric supply network. The throttle valve 14 is located in a pipeline 15 which feeds water or other suitable liquids to the spray nozzles 3B. In this way, the throttle valve 14 is adjusted so that there is an adequate supply or amount of water delivered by lines 16 and 17 to the nozzles 3B for the then existing speed at which the drum-cutting machine advances along the mine face.

The embodiment of FIG. 2 differs from that already described in regard to FIG. 1 by the replacement of the throttle valve 14 with a different arrangement of parts used to control the flow of water to the nozzles 3B. As illustrated in FIG. 2, the water feed line 15 is subdivided into three parallel branch lines 18, 19 and 20 and these lines include a controllable check valve 21, 22 and 23, respectively. The check valves include controllable actuating devices such as, for example, servomotors that are energized by an electrical current passed through the respective contacts 25, 26 and 27 by movable contacts positioned by a stepping mechanism 24.

The stepping mechanism is controlled by the output signal from the controller 9 and, depending upon the signal current or voltage, the mechanism mechanically displaces movable contacts 28, 29 and 30 so as to deliver an operating current from conductor line 31 to the solenoid valves. As indicated, the operation of the stepping mechanism 24 is responsive to the strength of the signal delivered to it by the controller 9. Depending upon this signal, the mechanism 24 moves contact 28 into conducting relation with contact 25, or moves contacts 28 and 29 into conducting relation with contacts 25 and 26, respectively, or in the event of a very strong signal from the controller 9, the mechanism 24 moves contacts 28, 29 and 30 into conducting relation with contacts 25, 26 and 27, respectively. Consequently, as the speed at which the drum-cutting machine increases as it moves along the mine face during a mining operation, the check valves in the individual branch lines of the water delivery pipe are opened in sequence, thereby increasing the amount of water flowing in pipe 16 and 17 per unit of time to the spray nozzles 3B.

Figure 3:
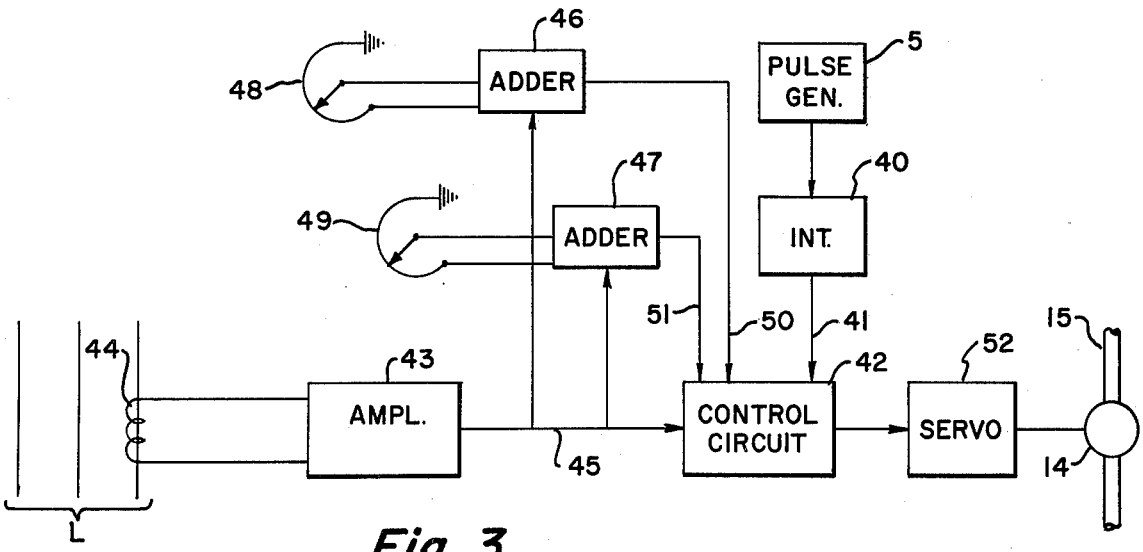
FIG. 3 is a schematic diagram illustrating in greater detail the control circuit according to FIGS. 1 and 2.

FIG. 3 illustrates more specific details of the electric control circuit used to adjust the flow of water in pipeline 15. In this regard, the pulse generator transmitter 5 delivers its pulse output to an integrating circuit 40 which provides a continuous electrical signal in line 41 that is proportional to the speed of the capstan drive or, in other words, the speed at which the drum-cutting machine is traversed along a mine face. This signal is fed to a control circuit 42 which may, if desired, take the form of a computer. The control circuit 42 receives the input from an amplitude discriminator 43 that is, in turn, coupled to the secondary winding 44 of a transformer that is coupled to one of the power supply lines L. The secondary winding 44 of the transformer delivers a signal proportional to the current passed by the line L to the drive motor. The amplitude discriminator 43 delivers a signal over line 45 only when the current passed by line L exceeds a predetermined set level as previously described. The signal in line 45 is also delivered to adder circuits 46 and 47, each of which is coupled to a manually-adjustable potentiometer 48 and 49 that may be adjusted to provide a biasing signal in lines 50 and 51 characteristic of factors such as the dimensions or drive ratio of the capstan drive 4 and properties of the materials to be released including, for example, the rate at which dust is produced during the actual mining operation of the ore. The signals in lines 50 and 51 are used in the control circuit to bias the signal received over line 41 so that after an enabling signal is delivered from the amplitude discriminator 43, a signal is delivered by the control circuit 42 to a servomotor 52 to control the throttle valve 14 in the water supply line 15.

According to the practical examples illustrated and described in regard to FIGS. 1–3, only one drive motor 10 is provided which drives both drum cutters 3. Thus, when one of the two cutting drums has reached the end of the longwall mine face whereby it is no longer cutting material therefrom, the other cutting drum which is to the rear of the machine will still be operating on the rock or coal. When this occurs the spray nozzles 3B for both of the drum cutters will still be supplied with water by pipelines 16 and 17. However, the drum-cutting machine will no longer release coal at the same rate which it did just prior thereto. This drawback is directly due to the fact that both drum cutters are driven by the same motor.

When separate drive motors are provided for the two drum cutters, it then becomes possible to utilize two current detecting transformers in the current supply lines for these drive motors. In this way, each of the two drum cutters may have separate regulating controls according to the present invention to control the supply of water to the spray nozzles. With such an arrangement, the water sprays associated with the drum cutters will immediately cease discharging water even while the capstan drive continues to run as soon as the current to the drive motor associated with a cutting drum falls below the off-load current, thereby indicating that the drum is no longer working on the mine face.

Although the invention has been shown in connection with certain specific embodiments, it will be readily apparent to those skilled in the art that various changes in form and arrangement of parts may be made to suit requirements without departing from the spirit and scope of the invention.

I claim as my invention:

1. A method of controlling the quantity of water discharged from a nozzle device toward cutting tools during operation of a drum-cutting mining machine of the type which is traversed by a drive along the longwall of the mine, the cutting tools being carried by a cutter head that is rotated by a motor on the mining machine to release material from the face of the mine, said method including the steps of detecting the speed at which said drum-cutting mining machine moves along by generating an electrical signal corresponding to the speed of movement thereof relative to the mine face, and proportionately controlling the water discharge rate by said nozzle device in response to said electrical signal.

2. The method according to claim 1 which includes the further step of inhibiting the discharge of water by said nozzle device until rotation of said cutter head by said motor.

3. The method according to claim 1 which includes the further steps of detecting the passage of electric current above a predetermined level to said motor to thereby indicate release of material from the face of the mine by the rotating operation of said cutter head, and producing an electrical signal in response to the detected passage of an electric current to enable the discharge of water from said nozzle device and for said step of controlling the water discharge rate.

4. The method according to claim 1 wherein said step of controlling the water discharge rate includes controlling a plurality of valves in a sequential manner to adjust the supply of water to said nozzle device.

5. The method according to claim 1 wherein said step of controlling the water discharge rate includes controlling the water discharged by each of a plurality of separate branch lines to a water supply line by separately controlling the water passing into each branch line to change the quantity of water supplied to said nozzle device in a step-like manner.

6. In an extracting machine of the type having a drive employed to traverse the machine along a mine face for underground mining operations, an apparatus for controlling the quantity of water or the like which is discharged toward cutting tools that are rotated by a drive motor on the mining machine during the actual mining operation, said apparatus including electrical detecting means for providing a signal which varies with the rate at which said mining machine moves along the face of the mine, and control means responsive to the signal from said detecting means for adjusting the quantity of water discharged toward the cutting tools of said drum-cutting mining machine.

7. An apparatus according to claim 6 wherein said control means includes a valve operated by a solenoid device in response to the signal from said means for detecting.

8. An apparatus according to claim 6 wherein said detecting means includes a pulse transmitter coupled to said drive for producing pulses at a rate which is proportional to the rate at which the extracting machine is traversed along the mine face, means responsive to the passage of an electrical current to the drive motor which rotates the cutting tools for producing an enabling signal when the passage of such an electrical current exceeds a predetermined idle current, and a controller responsive to the pulse from said pulse transmitter and enabled by said enabling signal for delivering a control signal to said control means.

9. An apparatus according to claim 8 wherein said means for producing an enabling signal includes the secondary winding of a transformer coupled in the current supply lines for said drive motor.

* * * * *